US011071439B2

(12) United States Patent
Roos et al.

(10) Patent No.: US 11,071,439 B2
(45) Date of Patent: Jul. 27, 2021

(54) BRACKET, DISHWASHER AND METHOD OF ATTACHING A STRUCTURE TO A WALL OF A DISHWASHER

(71) Applicant: ELECTROLUX APPLIANCES AKTIEBOLAG, Stockholm (SE)

(72) Inventors: Matteus Roos, Stockholm (SE); Per Källberg, Stockholm (SE); Erik Josefsson, Stockholm (SE); Christian Henriksen, Stockholm (SE)

(73) Assignee: Electrolux Appliances Aktiebolag

( * ) Notice: Subject to any disclaimer, the term of this patent is extended or adjusted under 35 U.S.C. 154(b) by 400 days.

(21) Appl. No.: 15/778,779

(22) PCT Filed: Dec. 21, 2015

(86) PCT No.: PCT/EP2015/080814
§ 371 (c)(1),
(2) Date: May 24, 2018

(87) PCT Pub. No.: WO2017/108078
PCT Pub. Date: Jun. 29, 2017

(65) Prior Publication Data

US 2018/0368651 A1 Dec. 27, 2018

(51) Int. Cl.
*A47L 15/42* (2006.01)
*A47L 15/50* (2006.01)

(52) U.S. Cl.
CPC ..... *A47L 15/4246* (2013.01); *A47L 15/504* (2013.01); *A47L 15/506* (2013.01)

(58) Field of Classification Search
CPC ... A47L 15/4246; A47L 15/506; A47L 15/504
See application file for complete search history.

(56) References Cited

U.S. PATENT DOCUMENTS

| | | | | |
|---|---|---|---|---|
| 3,044,842 A | | 2/1962 | Abresch et al. | |
| 3,466,108 A | * | 9/1969 | Guth | A47L 15/506 312/274 |
| 3,560,069 A | * | 2/1971 | Doepke | A47L 15/504 312/351 |
| 3,726,580 A | * | 4/1973 | Guth | A47L 15/504 312/351 |
| 3,726,581 A | * | 4/1973 | Doepke | A47L 15/504 312/351 |
| 3,736,037 A | * | 5/1973 | Doepke | A47B 51/00 312/351 |

(Continued)

OTHER PUBLICATIONS

Office Action for Brazilian Application No. BR 112018011084-1 dated Mar. 5, 2020, 4 pages.

(Continued)

*Primary Examiner* — Benjamin L Osterhout
(74) *Attorney, Agent, or Firm* — RatnerPrestia

(57) ABSTRACT

A bracket is provided that may be configured to attach a structure to a wall inside a wash tub of a dishwasher. The bracket may be arranged to be attached to the structure and may include a first protrusion and at least a second protrusion arranged to attach the bracket and the attached structure to the wall by extending through a respective aperture in the wall. A dishwasher and a method of attaching a structure to a wall inside a wash tub for a dishwasher may also be provided.

15 Claims, 6 Drawing Sheets

(56) References Cited

U.S. PATENT DOCUMENTS

| | | | | |
|---|---|---|---|---|
| 3,822,084 | A * | 7/1974 | Brezosky | A47L 15/4246 312/351.3 |
| 3,822,085 | A * | 7/1974 | Clark | A47L 15/504 312/351 |
| 5,860,716 | A * | 1/1999 | Good | A47L 15/504 312/311 |
| 2008/0129168 | A1 * | 6/2008 | Banta | A47L 15/506 312/333 |
| 2009/0050186 | A1 | 2/2009 | Kim et al. | |
| 2012/0074080 | A1 | 3/2012 | Garcia et al. | |
| 2012/0176010 | A1 | 7/2012 | Buehlmeyer et al. | |
| 2013/0057132 | A1 | 3/2013 | Flowers et al. | |
| 2015/0190033 | A1 | 7/2015 | Shaffer et al. | |

OTHER PUBLICATIONS

International Search and Written Opinion for Application No. PCT/EP2015/080814 dated Feb. 8, 2016, 10 pages.

* cited by examiner

BRACKET, DISHWASHER AND METHOD OF ATTACHING A STRUCTURE TO A WALL OF A DISHWASHER

CROSS-REFERENCE TO RELATED APPLICATIONS

This application is a national stage application filed under 35 U.S.C. § 371 of International Application No. PCT/EP2015/080814 filed Dec. 21, 2015, which application is hereby incorporated by reference in its entirety.

TECHNICAL FIELD

The present invention relates to a bracket configured to attach a structure to a wall inside a wash tub of a dishwasher, a dishwasher comprising a bracket, and a method of attaching a structure to a wall inside a wash tub for a dishwasher.

BACKGROUND

Today's consumer market requires high quality products which can be provided in a cost efficient manner. In order to be able to provide products at a low cost, an important aspect is to have an efficient production line where mounting steps of components can be performed in a time efficient manner. In a modern dishwasher, various structures are usually mounted to walls inside the wash tub. A wash tub of a dishwasher is a compartment of the dishwasher where items are washed. The washing is usually performed by spraying washing liquid into the wash tub and onto the items using spray arrangements arranged in the wash tub.

One example of such a structure to be mounted onto walls inside a wash tub of a dishwasher is a rail for a rack adapted to accommodate items to be washed. Another example is described in the document US2012074080 A1. The document US2012074080 A1 relates to a structure for adjusting the height of a rack where the rack is guided in a dishwasher by a pull-out guide. The structure described requires a rigid mounting to the walls inside a wash tub since a rack filled with items to be washed will have a high weight and will thus incur considerable forces and torques at mounting points of the structure.

Mounting of structures to walls inside a wash tub of a dishwasher is usually performed using screws, or similar, to mount the structure from within the wash tub to walls inside the wash tub. In a production line of dishwashers an assembler usually has to hold the structure onto the wall inside the wash tub, or attach the structure onto the wall in some other way, while mounting the screws. Problems with such mounting are that it is burdensome and that it is time consuming. Another problem is that it easily leads to scratches in the walls inside the wash tub. Such scratches may reduce the lifespan of the wash tub since there is a corrosive environment within the wash tub during, and after, a washing phase. Thereby, portions of the wall having scratches may corrode. Further, such scratches may have a negative impact on the impression of the final product, i.e. the dishwasher. A further problem with such mounting is that screws, or similar, need to have a certain length to function and that requires space.

Attempts have been made to facilitate mounting of structures onto walls inside a wash tub of a dishwasher.

The document US2015190033 A1 relates to a dishwasher appliance and a method for mounting a slide rail within a dishwasher appliance. A rack assembly of the dishwasher appliance includes a bracket with a post. A slide rail is mounted to the bracket, and the slide rail and the bracket are positioned within a wash chamber of the dishwasher appliance. The post extends through the tub, and a sleeve is positioned opposite the bracket on the tub and engages the post. The sleeve hinders retraction of the post through the tub.

The dishwasher appliance described in US2015190033 A1 is associated with some problems. One problem is that it only partially facilitates mounting of a structure to a wall of a wash tub.

SUMMARY

An object of the present invention is to facilitate mounting of a structure to a wall inside a wash tub of a dishwasher.

According to an aspect of the invention, the object is achieved by a bracket configured to attach a structure to a wall inside a wash tub of a dishwasher, wherein the bracket is arranged to be attached to the structure, and wherein the bracket comprises a first protrusion and at least a second protrusion, wherein the first protrusion and the at least second protrusion are arranged to attach the bracket, and the attached structure, to the wall by extending through a respective aperture in the wall.

Thereby, an assembler may attach the bracket, and the attached structure, to the wall inside the wash tub simply by inserting the first protrusion and the at least second protrusion into a respective aperture in the wall.

Further, since the first protrusion and the at least second protrusion are arranged to attach the bracket, and the attached structure, to the wall by extending through a respective aperture in the wall, the bracket, and the attached structure can be attached to the wall without the assembler having to apply screws, or similar, from the inside of the wash tub.

Still further, the assembler may further secure the bracket, and the attached structure, to the wall using further fastening means without having to hold the structure onto the wall inside a wash tub. Since the first protrusion and the at least second protrusion are arranged to extend through a respective aperture in the wall, such fastening means may thus be applied from an outside of the wash tub thus further facilitating mounting of the structure.

Still further, since the first protrusion and the at least second protrusion are arranged to attach the bracket, and the attached structure, to the wall by extending through a respective aperture in the wall, the bracket, and the attached structure can easily be attached in a predetermined position at the wall inside the wash tub.

Still further, since the bracket comprises a first protrusion and at least a second protrusion arranged to attach the bracket, and the attached structure, to the wall, an assembler may not have to attach several brackets onto a structure, which is the case with the brackets described in the document US2015190033 A1. As a further result, a bracket is provided reducing the risk of scratching the wall upon attachment.

Accordingly, a bracket is provided facilitating mounting of a structure to a wall inside a wash tub of a dishwasher. Thus, the above mentioned object is achieved.

Further, since the bracket facilitates mounting of a structure to a wall inside a wash tub of a dishwasher, a bracket is provided capable of reducing manufacturing costs of a dishwasher.

Optionally, the first protrusion and the at least second protrusion are arranged to secure the bracket, and the attached structure, to the wall by receiving a respective fastening element. Since the first protrusion and the at least second protrusion are arranged to extend through a respective aperture in the wall, a respective fastening element may thus be applied from an outside of the wash tub onto each one of the first protrusion and the at least second protrusion to secure the bracket, and the attached structure, to the wall of the wash tub.

Accordingly, a bracket is provided further facilitating mounting of a structure to a wall inside a wash tub of a dishwasher.

Optionally, the first protrusion and the at least second protrusion are provided with respective threads and are arranged to receive a respective fastening element comprising threads. Thereby, a simple and reliable securing of the bracket, and the attached structure, to the wall of the wash tub is provided.

Optionally, the bracket further comprises a third protrusion arranged to attach the bracket to the wall by extending through a further aperture in the wall. Thereby, a bracket is provided capable of attaching heavier and more torque demanding structures. In addition, a bracket is provided further ensuring attachment of the bracket, and the attached structure, to the wall inside the wash tub.

Optionally, the first, second and third protrusions are arranged at positions of the bracket defining corners of a triangle. Thereby, forces in the wall of the wash tub will be more evenly distributed when the bracket and the attached structure is attached to the wall. As a result, a bracket is provided capable of attaching even heavier and even more torque demanding structures. As a further result, a bracket is provided further ensuring attachment of the bracket, and the attached structure, to the wall inside the wash tub.

Optionally, the bracket further comprises portions adjacent to the first protrusion and the at least second protrusion, wherein each portion is arranged to form a watertight seal around a respective aperture in the wall when the bracket is attached to the wall. Thereby, reliable watertight seals around the respective apertures are provided using few components. Since watertight seals can be provided using few components, a bracket is provided which further facilitates mounting of a structure to a wall inside a wash tub of a dishwasher. In addition, a bracket is provided which can be manufactured in a cost efficient manner.

Optionally, the bracket comprises a polymeric material. Thereby, a bracket is provided which can be manufactured in a cost efficient manner. Further, a bracket is provided having a low weight. Still further, a bracket is provided reducing the risk of scratching the wall upon attachment. Even further, reliable watertight seals around the respective apertures can be further ensured.

Optionally, the bracket is arranged to be attached to the structure by a respective threaded fastening element extending into a respective one of the first protrusion and the at least second protrusion. Thereby, the bracket can be attached to the structure, prior to attaching the bracket, and the attached structure, to the wall, in a simple and reliable manner. A threaded fastening element requires a certain length. Since the bracket is arranged to be attached to the structure by a respective threaded fastening element extending into a respective one of the first protrusion and the at least second protrusion, the threaded fastening elements will thus extend into a respective protrusion and will thereby not require any additional space. As a further result, the threaded fastening elements will contribute to rigidity of each protrusion thus further ensuring attachment of the bracket, and the attached structure, to the wall.

According to a further aspect of the invention, the object is achieved by a dishwasher comprising a bracket according to some embodiments.

Optionally, the dishwasher further comprises a structure attached to the wall inside the wash tub of the dishwasher by the bracket, wherein the structure is an apparatus for adjusting height of a rack of the dishwasher. Such structure involves considerable weight, especially when the rack is filled with items. The bracket ensures a facilitated mounting of such a structure, as well as a rigid mounting since the bracket comprises a first protrusion and at least a second protrusion arranged to attach the bracket, and the attached structure, to the wall by extending through a respective aperture in the wall of the wash tub.

According to a further aspect of the invention, the object is achieved by a method of attaching a structure to a wall inside a wash tub for a dishwasher, using a bracket comprising a first protrusion and at least a second protrusion, wherein the method comprises:

attaching the bracket to the structure, and attaching the bracket, and the attached structure, to the wall, by inserting the first protrusion and the at least second protrusion into a respective aperture in the wall, wherein the first protrusion and the at least second protrusion are arranged to extend through the respective aperture in the wall when inserted.

Thereby, a method is provided allowing an assembler to attach the bracket, and the attached structure, to the wall inside the wash tub simply by inserting the first protrusion and the at least second protrusion into a respective aperture in the wall.

Further, a method is provided allowing an assembler to attach the bracket, and the attached structure, to the wall without having to apply screws, or similar, from the inside of the wash tub.

Still further, a method is provided allowing an assembler to further secure the bracket, and the attached structure, to the wall using further fastening means without having to hold the structure onto the wall inside a wash tub. Since the first protrusion and the at least second protrusion is arranged to extend through a respective aperture in the wall, such fastening means may be applied from an outside of the wash tub further facilitating mounting of the structure.

Still further, since the method comprises attaching the bracket, and the attached structure, to the wall by inserting the first protrusion and the at least second protrusion into a respective aperture in the wall, the attached structure can easily be attached in a predetermined position at the wall inside the wash tub.

Still further, a method is provided in which an assembler doesn't have to attach several brackets onto a structure, which is the case of the brackets described in the document US2015190033 A1. As a further result, a method is provided reducing the risk of scratching the wall upon attachment.

Accordingly, a method is provided facilitating mounting of a structure to a wall inside a wash tub of a dishwasher. Thus, the above mentioned object is achieved.

Further, since the method facilitates mounting of a structure to a wall inside a wash tub of a dishwasher, a method is also provided capable of reducing manufacturing costs of a dishwasher.

Optionally, the method further comprises:

securing the bracket, and the attached structure, to the wall by applying a respective fastening element onto the first protrusion and the at least second protrusion.

Since the first protrusion and the at least second protrusion are arranged to extend through a respective aperture in the wall, the respective fastening element may be applied from an outside of the wash tub onto each one of the first protrusion and the at least second protrusion to secure the bracket, and the attached structure, to the wall of the wash tub. Accordingly, a method is provided further facilitating mounting of a structure to a wall inside a wash tub of a dishwasher.

Optionally, the method further comprises:

attaching the bracket to the structure by means of a respective threaded fastening element extending into a respective one of the first protrusion and the at least second protrusion.

Thereby, a method is provided allowing attachment of the bracket to the structure, prior to attaching the bracket, and the attached structure, to the wall, in a simple and reliable manner. A threaded fastening element requires a certain length. Since the method comprises attaching the bracket to the structure by means of a respective threaded fastening element extending into a respective one of the first protrusion and the at least second protrusion, the threaded fastening elements will thus extend into a respective protrusion and will thus not require any additional space. As a further result, the threaded fastening elements will contribute to rigidity of each protrusion thus further ensuring attachment of the bracket, and the attached structure, to the wall.

Further features of, and advantages with, the present invention will become apparent when studying the appended claims and the following detailed description. Those skilled in the art will realize that the different features described may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

Embodiments herein will now be described more fully with reference to the accompanying drawings, in which example embodiments are shown. Disclosed features of example embodiments may be combined as readily understood by one of ordinary skill in the art. Like numbers refer to like elements throughout.

Well-known functions or constructions will not necessarily be described in detail for brevity and/or clarity.

Figure 1:
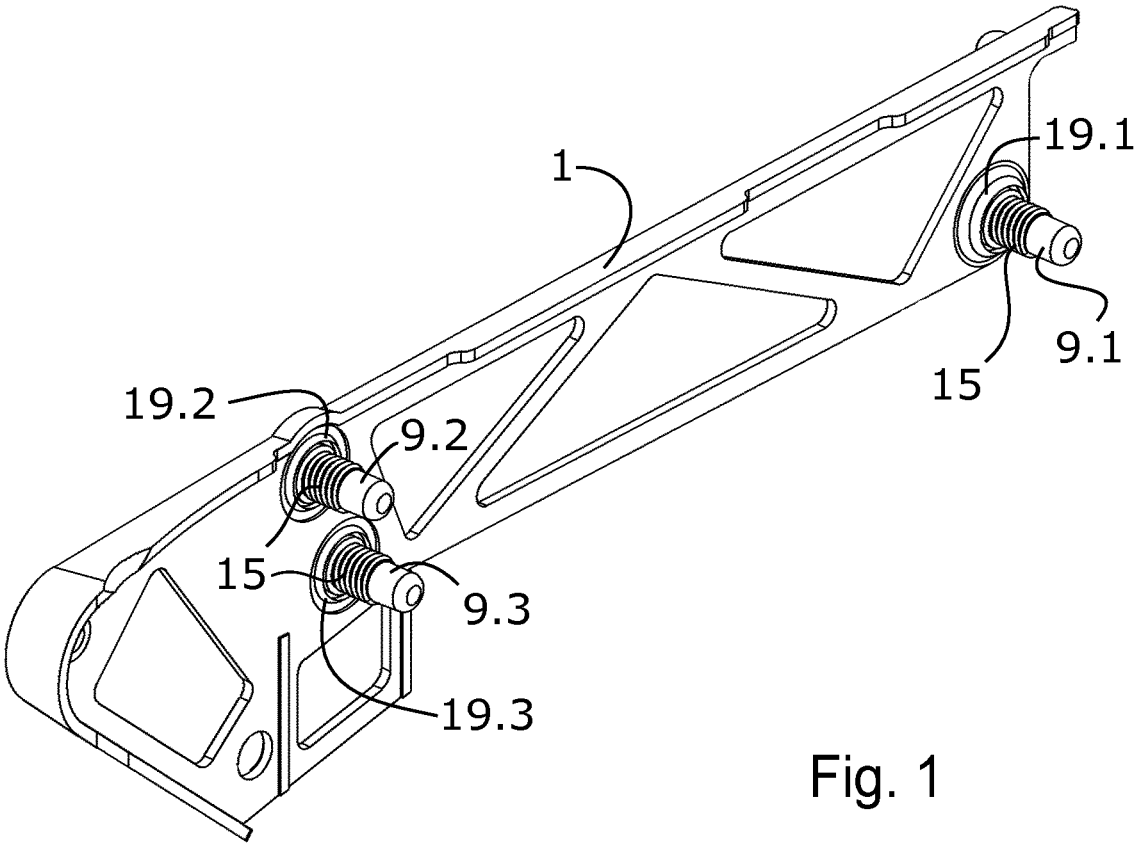
FIG. 1 illustrates a bracket, according to some embodiments.

FIG. 1 illustrates a bracket 1 configured to attach a structure to a wall inside a wash tub of a dishwasher. The bracket 1 is arranged to be attached to the structure.

Figure 2:
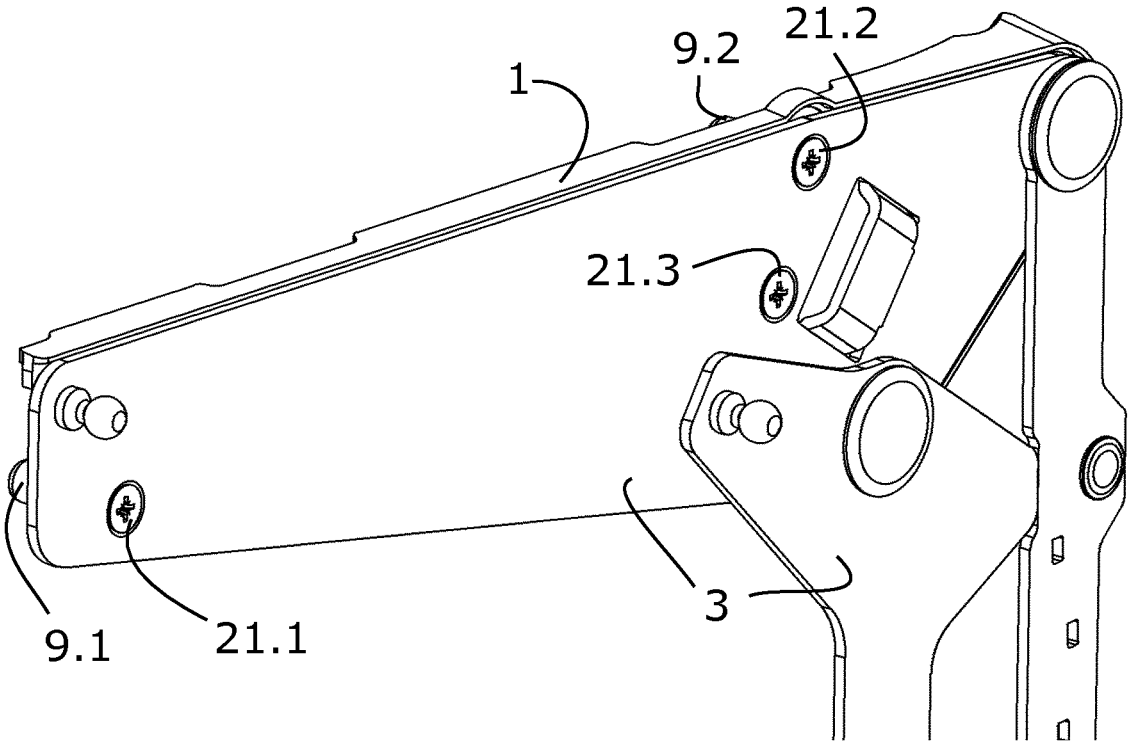
FIG. 2 illustrates the bracket, illustrated in FIG. 1, attached to a structure.

FIG. 2 illustrates the bracket 1 attached to a structure 3. The bracket 1 illustrated is attached to the structure 3 by a respective threaded fastening element 21.1, 21.2, 21.3. As an alternative to the threaded fastening elements 21.1, 21.2, 21.3, or in addition thereto, the bracket 1 may be arranged to be attached to the structure 3 by gluing, welding, riveting, moulding, over-moulding, heat treatment and/or snap fittings.

In the embodiments of the bracket 1 illustrated in FIG. 1, the bracket 1 comprises a first protrusion 9.1, a second protrusion 9.2, and a third protrusion 9.3. The protrusions 9.1, 9.2, 9.3 are arranged to attach the bracket 1, and an attached structure, to a wall inside a wash tub of a dishwasher by extending through a respective aperture in the wall.

Figure 3:
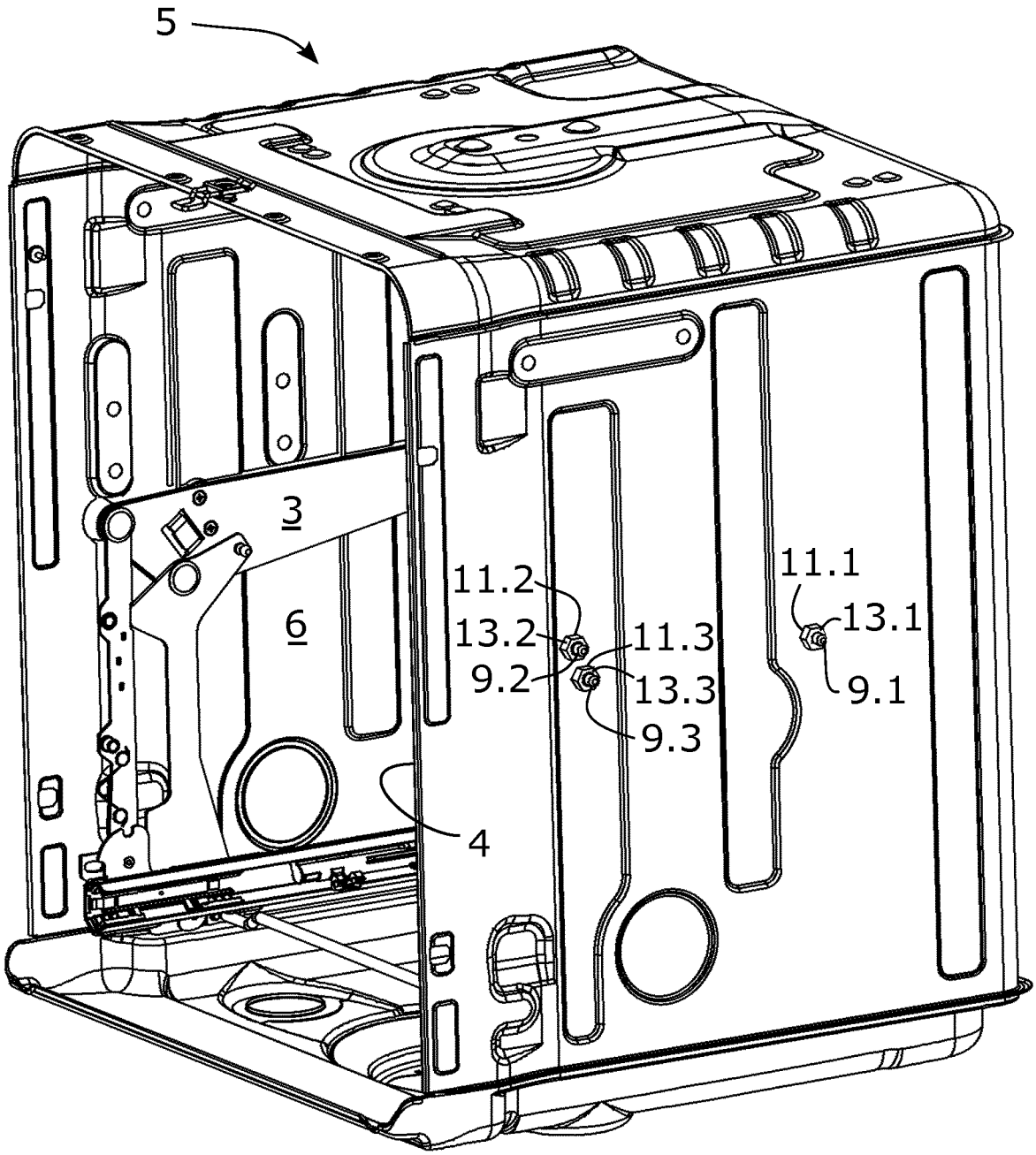
FIG. 3 illustrates wash tub of a dishwasher comprising the bracket.

FIG. 3 illustrates wash tub 3 of a dishwasher comprising an attached bracket. As illustrated, the protrusions 9.1, 9.2, 9.3 are arranged to attach the bracket, and an attached structure, to a wall 4 inside a wash tub 5 of the dishwasher by extending through a respective aperture 11.1, 11.2, 11.3 in the wall 4.

The first protrusion 9.1, the second protrusion 9.2 and the third protrusion 9.3 is arranged to secure the bracket, and the attached structure, to the wall 4 by receiving a respective fastening element 13.1, 13.2, 13.3.

In the embodiments illustrated, each one of the first protrusion 9.1, the second protrusion 9.2 and the third protrusion 9.3 is provided with respective threads and each one is arranged to receive a respective fastening element 13.1, 13.2, 13.3 comprising threads. In the embodiments illustrated, the fastening elements 13.1, 13.2, 13.3 comprise nuts.

The wash tub 3 illustrated in FIG. 3 comprises a second bracket at an opposite side of the wash tub 5. The second bracket attaches a structure 3 to a wall 6 on the opposite side of the wash tub 5. The bracket, not visible in FIG. 3, also attaches the structure 3 to the wall 4 of the wash tub 5. The structure 3 illustrated is an apparatus for adjusting height of a rack of a dishwasher.

Figure 4:
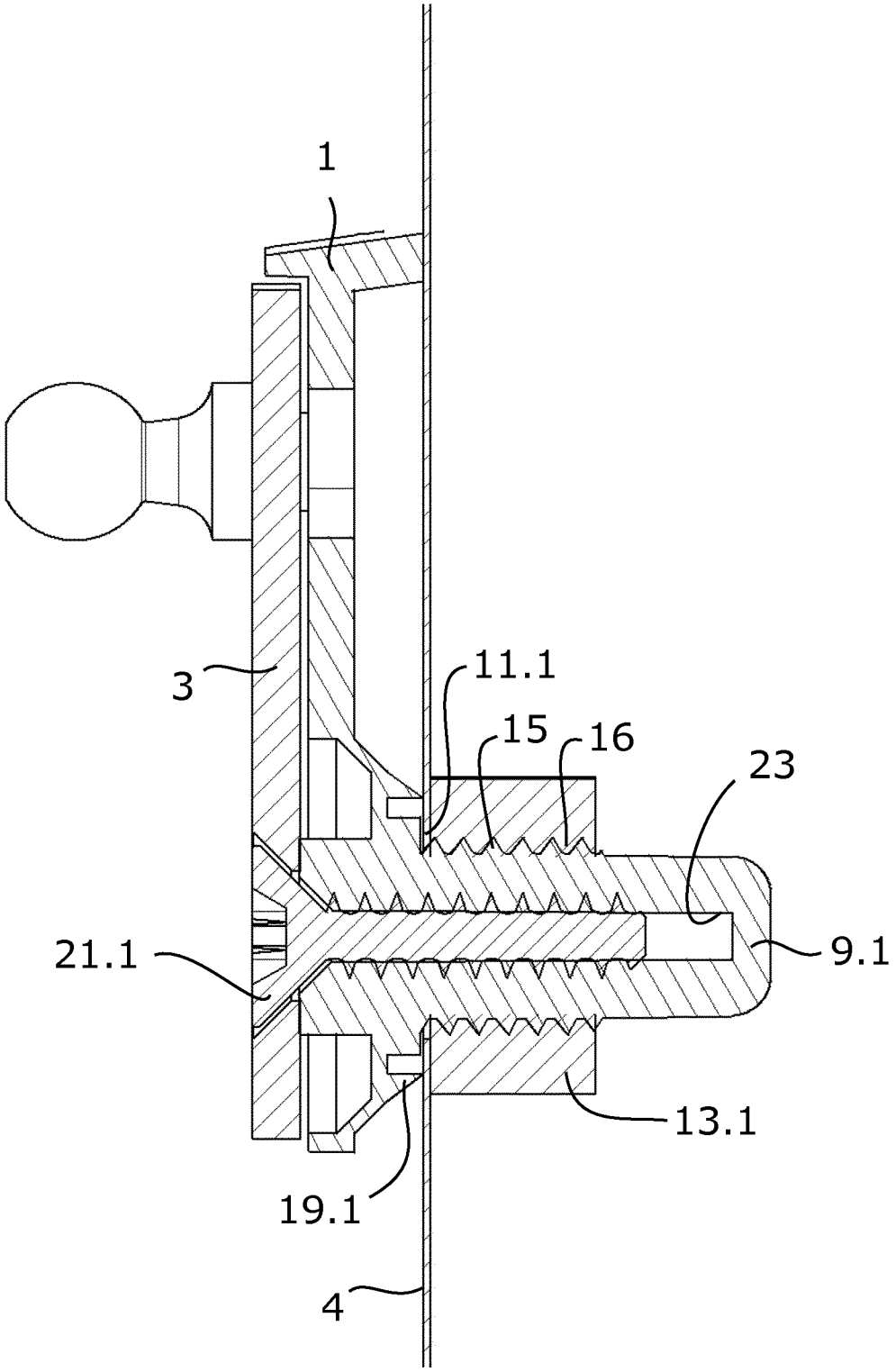
FIG. 4 illustrates a cross section of a first protrusion extending through a wall of the wash tub, illustrated in FIG. 3.

FIG. 4 illustrates a cross section of the first protrusion 9.1 extending through the wall 4 of the wash tub 5 illustrated in FIG. 3. In the embodiments illustrated, the bracket 1 is attached to the structure 3 by a threaded fastening element 21.1 extending into the first protrusion 9.1. The first protrusion 9.1 comprises an aperture 23 arranged to receive the threaded fastening element 21.1. Since the threaded fastening element 21.1 extends into the first protrusion 9.1, the threaded fastening element 21.1 will contribute to rigidity of each protrusion thus further ensuring attachment of the bracket 1, and the attached structure 3, to the wall 4. Further, the threaded fastening element 21.1 is provided with a certain length but will not, when mounted, require any additional space since it extends into the first protrusion 9.1.

In the embodiments illustrated, after the bracket 1 has been attached to the structure 3 by a threaded fastening element 21.1, an assembler may insert the first protrusion 9.1 into the aperture 11.1 of the wall 4 to attach the bracket 1 and the attached structure 3 to the wall 4. The bracket 1 is configured to attach to the wall 4 by at least one of diameter ratios between the respective protrusion 9.1 and the respective aperture 11.1, a length of the respective protrusion 9.1, positions of the protrusions 9.1 at the bracket 1 and the protrusions 9.1 being arranged to extend through apertures 11.1 of a vertical wall 4 inside the wash tub.

After attachment of the bracket 1 and the attached structure 3 to the wall 4 by insertion of the first protrusion 9.1 into the aperture 11.1 of the wall 4, the assembler may further secure the bracket 1, and the attached structure 3, to the wall 4 by applying a fastening element 13.1 onto the first protrusion 9.1. In the embodiments illustrated, the first protrusion 9.1 is provided with threads and the fastening element 13.1 is provided with corresponding threads 16 intermeshing with the threads 15 of the first protrusion 9.1. Thereby, a simple and reliable securing is provided of the bracket 1, and the attached structure 3, to the wall 4 of the wash tub.

As illustrated in FIG. 1, the bracket 1 comprises portions 19.1, 19.2, 19.2 adjacent to the first protrusion 9.1, the second protrusion 9.2 and the third protrusion 9.3. Each portion 19.1, 19.2, 19.3 is arranged to form a watertight seal around a respective aperture in the wall 4 when the bracket 1 is attached to the wall 4.

The portion 19.1 adjacent to the first protrusion 9.1 is also illustrated in FIG. 4. In the embodiments illustrated, the portion 19.1 comprises a ring-shaped ridge surrounding an interface between a main body of the bracket 1 and the first protrusion 9.1. The ring-shaped ridge is arranged to deform upon tightening of the fastening element 13.1. Due to the deformation of the ring-shaped ridge, a watertight seal around the aperture 11.1 in the wall 4 is further ensured. Thus, a bracket 1 is provided ensuring a watertight seal around the aperture 11.1 in the wall 4 without the use of a separate gasket.

In the embodiments illustrated, and which can be seen in FIG. 1-3, the first, second and third protrusions 9.1, 9.2, 9.3 are arranged at positions of the bracket 1 defining corners of a triangle. Thereby, forces in the wall 4 of the wash tub 5 will be more evenly distributed when the bracket 1, and the attached structure 3 is attached to the wall 4. As a result, a bracket 1 is provided capable of attaching even heavier and even more torque demanding structures 3.

The feature that the first, second and third protrusions 9.1, 9.2, 9.3 are arranged at positions of the bracket 1 defining corners of a triangle may also be defined as the third protrusion 9.3 being arranged at a position of the bracket 1 differing from a straight line drawn between the first protrusion 9.1 and the second protrusion 9.2.

However, the first, second and third protrusions 9.1, 9.2, 9.3 may also be arranged in a straight line at the bracket 1. Further, the bracket 1 may comprise more than three protrusions which may either be arranged in a straight line, or in another pattern at the bracket 1.

The bracket 1 may comprise a polymeric material. The polymeric material may for example be Polypropylene (PP), also known as polypropene, and/or Polyoxymethylene (POM), also known as acetal, polyacetal and polyformaldehyde. As can be seen in FIG. 1, as well as in FIG. 4, the bracket 1 may be formed by a coherent piece of material. Thereby, the bracket 1 may be produced in a cost efficient manner and may require no assembly of parts after production.

Figure 5:
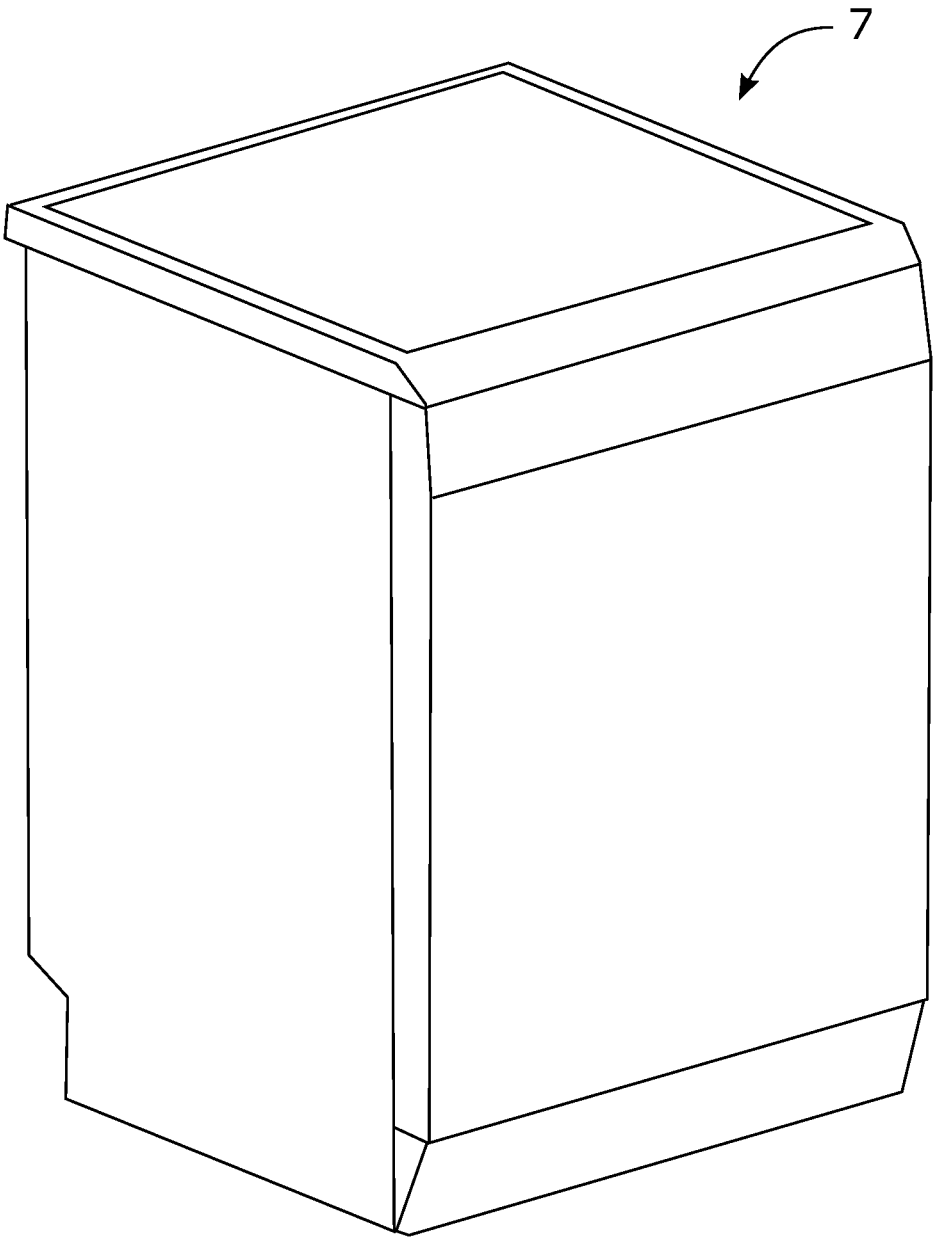
FIG. 5 illustrates a dishwasher comprising the wash tub illustrated in FIG. 3.

FIG. 5 illustrates a dishwasher 7 comprising the wash tub 3 illustrated in FIG. 3.

Figure 6:
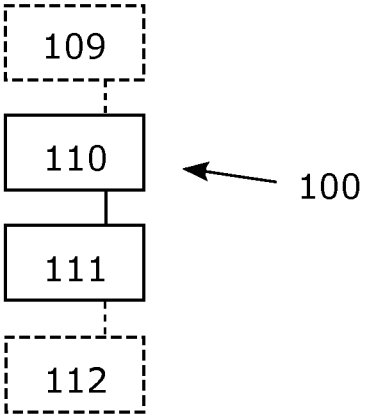
FIG. 6 illustrates a method of attaching a structure to a wall inside a wash tub for a dishwasher.

FIG. 6 illustrates a method 100 of attaching a structure to a wall inside a wash tub for a dishwasher, using a bracket comprising a first protrusion and at least a second protrusion, wherein the method 100 comprises:

attaching 110 the bracket to the structure, and attaching 111 the bracket, and the attached structure, to the wall, by inserting the first protrusion and the at least second protrusion into a respective aperture in the wall, wherein the first protrusion and the at least second protrusion are arranged to extend through the respective aperture in the wall when inserted.

As illustrated, the method 100 may further comprise:

securing 112 the bracket, and the attached structure, to the wall by applying a respective fastening element onto the first protrusion and the at least second protrusion.

As illustrated, the method 100 may comprise:

attaching 109 the bracket to the structure by means of a respective threaded fastening element extending into a respective one of the first protrusion and the at least second protrusion.

The invention claimed is:

1. A bracket configured to attach a structure to a wall inside a wash tub of a dishwasher, wherein said bracket is arranged to be attached to said structure, said bracket comprising:

an extended portion configured to, when said bracket is attached to said wall, extend along at least a portion of said wall;

a first protrusion protruding from said extended portion; and at least a second protrusion protruding from said extended portion, wherein said first protrusion and said at least second protrusion are arranged to attach said bracket, and said attached structure, to said wall by extending through a respective aperture in said wall, wherein said bracket is configured to be attached to said wall in an instance in which said attached structure is attached to said bracket.

2. The bracket according to claim 1, wherein said first protrusion and said at least second protrusion are arranged to secure said bracket, and said attached structure, to said wall by receiving a respective fastening element.

3. The bracket according to claim 2, wherein said first protrusion and said at least second protrusion are provided with respective threads and are arranged to receive a respective fastening element comprising threads.

4. The bracket according to claim 1, further comprising a third protrusion arranged to attach said bracket to said wall by extending through a further aperture in said wall.

5. The bracket according to claim 4, wherein said first, second and third protrusions are arranged at positions of said bracket defining corners of a triangle.

6. The bracket according to claim 1, further comprising portions adjacent to said first protrusion and said at least second protrusion, wherein each portion is arranged to form a watertight seal around a respective aperture in said wall when said bracket is attached to said wall.

7. The bracket according to claim 1, wherein said bracket comprises a polymeric material.

8. The bracket according to claim 1, wherein said bracket is arranged to be attached to said structure by a respective threaded fastening element extending into a respective one of said first protrusion and said at least second protrusion.

9. The bracket of claim 1, wherein said first protrusion comprises an aperture configured to receive a fastening element therein such that the fastening element secures said structure to said bracket.

10. The bracket of claim 9, wherein said second protrusion comprises a second aperture for receiving a second fastening element therein such that the second fastening element secures said structure to said bracket.

11. A dishwasher comprising:

a wash tub defined at least in part by a wall; and a bracket configured to attach a structure to the wall inside the wash tub, wherein said bracket is arranged to be attached to said structure, said bracket comprising:

an extended portion configured to, when said bracket is attached to said wall, extend along at least a portion of said wall;

a first protrusion protruding from said extended portion; and at least a second protrusion protruding from said extended portion, wherein said first protrusion and said second protrusion are arranged to attach said bracket, and said attached structure, to said wall by extending through a respective aperture in said wall, and wherein said bracket is configured to be attached to said wall in an instance in which said attached structure is attached to said bracket.

12. The dishwasher according to claim 11, further comprising a structure attached to the wall inside the wash tub of the dishwasher by said bracket, wherein said structure is an apparatus for adjusting height of a rack of said dishwasher.

13. A method of attaching a structure to a wall inside a wash tub for a dishwasher, said method comprising:

attaching a bracket to said structure, said bracket comprising an extended portion configured to, when said bracket is attached to said wall, extend along at least a portion of said wall, a first protrusion protruding from said extended portion, and at least a second protrusion protruding from said extended portion; and attaching said bracket, having said attached structure attached thereto, to said wall, by inserting said first protrusion and said at least second protrusion into a respective aperture in said wall, wherein said first protrusion and said at least second protrusion are arranged to extend through said respective aperture in said wall when inserted.

14. The method according to claim 13, further comprising:

securing said bracket, and said attached structure, to said wall by applying a respective fastening element onto said first protrusion and said at least second protrusion.

15. The method according to claim 13, further comprising:

attaching said bracket to said structure by means of a respective threaded fastening element extending into a respective one of said first protrusion and said at least second protrusion.

* * * * *